United States Patent [19]

Curtis

[11] 4,079,982

[45] Mar. 21, 1978

[54] RELEASABLE LINE HOLDING APPARATUS

[76] Inventor: Arney L. Curtis, P.O. Box 232, Canyon City, Oreg. 97820

[21] Appl. No.: 699,196

[22] Filed: Jun. 23, 1976

Related U.S. Application Data

[63] Continuation-in-part of Ser. No. 634,408, Nov. 24, 1975, abandoned.

[51] Int. Cl.[2] ..... B66C 1/40

[52] U.S. Cl. ..... 294/83 R; 280/453

[58] Field of Search ..... 294/83 R, 83 A, 26; 114/210; 280/453; 267/69, 73, 74

[56] References Cited

U.S. PATENT DOCUMENTS

| | | | |
|---|---|---|---|
| 703,713 | 7/1902 | Smith et al. | 294/84 R |
| 1,294,696 | 2/1919 | Over | 280/453 |
| 1,536,656 | 5/1925 | Bryant | 294/83 R |

FOREIGN PATENT DOCUMENTS

| | | | |
|---|---|---|---|
| 540,971 | 3/1956 | Italy | 294/83 R |

*Primary Examiner*—James B. Marbert

*Attorney, Agent, or Firm*—Kolisch, Hartwell, Dickinson & Stuart

[57] ABSTRACT

Line holding apparatus including a tubular mounting member secured in a substantially stationary position to a support, a cap which fits against the end of the mounting member spaced outwardly from the support, and a spring yieldably biasing the cap against the end of the mounting member. An elongate arm secured to the cap extends upwardly therefrom to confine and hold a portion of a cable when the cap is held against the mounting member. A lip on the cap engages side surfaces of the mounting member to inhibit lateral shifting of the cap. A member attached to the cap engages a notch on the end of the tube to inhibit rotation of the cap and arm. A force applied by the line against the arm which is greater than the biasing force of the spring releases the arm in almost any direction in which the line force is applied. An adjustment device is provided for increasing or decreasing the tension force of the spring.

9 Claims, 4 Drawing Figures

RELEASABLE LINE HOLDING APPARATUS

This is a continuation-in-part of my prior-filed application entitled, "Releasable Line Holding Apparatus," filed Nov. 24, 1975, Ser. No. 634,408 now abandoned.

BACKGROUND AND SUMMARY OF THE INVENTION

This invention relates to apparatus for releasably holding a line adjacent a support.

When working with flexible cables, or other lines, there often are excess lengths of line which must be stored. In the past, such lines have been stored by looping portions of the lines over rigidly fixed supports or hooks. If, as occurs in many situations, a pulling force is applied to the line thus looped over the support, the rigid support provides no release capability. The support may either bend or break, it may produce breaking of the line, or it may allow the line to be snaked therefrom which may produce a whipping action of the free end of the line producing danger to personnel or equipment in the area of the free end of the line.

An example of the situation set out above is found in logging operations in which a cable is taken in or payed out from a winch on a tractor. Auxiliary cables, or choker cables, are slidably mounted on the main cable and are retained on the main cable by a stop secured to the outer end of the main cable. Several choker cables are slidably mounted on the main cable for connecting to either a single log or a plurality of logs which may be moved by the tractor. When all of the cables are not needed, it has been a general practice to loop the unused cables over fixed supports on the tractor. When the sliding connections between the choker cables and the main cable are operating properly, there is little, if any, force applied to the choker cable attempting to draw it from the fixed supports. However, should the slide mounting bind on the main cable as often happens as the main cable is forcibly payed out, then the force tending to draw the main cable out is applied also to the choker cable. When this occurs, the choker cable may apply such force to the rigid supports either bending or breaking the same, the choker cable may break, or the cable may be withdrawn longitudinally of the choker cable whereby it snakes off the support which may produce a whipping action of its loose end which presents a danger to equipment and personnel in the area.

A general object of the present invention is to provide a novel device for releasably holding a line adjacent a support, with the device being so constructed that should a force be applied to the line in substantially any direction, which force is greater than a preselected maximum force, the cable will be released to prevent damage to the support, cable, or personnel or equipment in the area of the cable.

More specifically, an object of the invention is to provide such a novel device which includes a mounting member secured to a support, an elongate arm spaced outwardly from the support and mounted for shifting between a substantially upright holding position and a laid over release position, and biasing means releasably connecting the arm to the mounting means urging the arm in the direction of its side against which a flexible member may bear but permitting release of the arm from its holding position toward its release position upon the application of a force to the arm which is greater than the force of the biasing means. The device of the instant invention is so constructed that a force applied to the arm in almost any direction which is greater than said preselected force is operable to shift the arm to its release position.

Yet another object is to provide such a novel device which is simply and economically constructed.

A still further object is to provide such a novel device including adjustment means for varying the force which the biasing means applies to the arm to permit varying of the preselected force necessary to overcome the holding of the biasing means.

These and other objects and advantages will become more fully apparent as the following description is read in conjunction with the drawings.

DRAWINGS

DETAILED DESCRIPTION OF AN EMBODIMENT OF THE INVENTION

Figure 1:
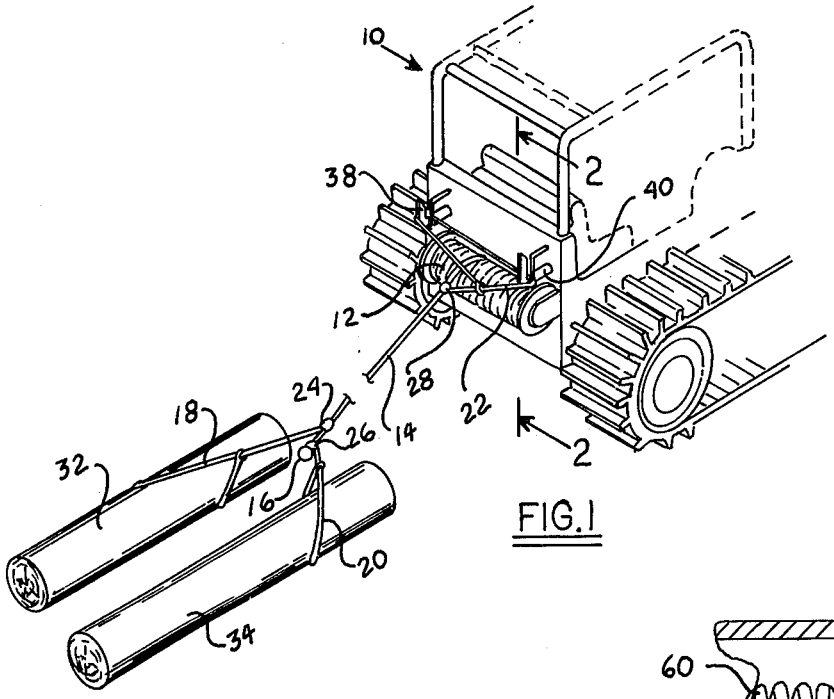
FIG. 1 is a perspective view of the rear end of a logging tractor in operation with line holding devices constructed according to an embodiment of the invention secured to the rear end of the tractor.

Referring to the drawings, and first specifically to FIG. 1, at 10 is indicated generally a logging tractor on the rear end of which is mounted a cable winch 12. A main working cable 14 is reeved on winch 12 and may be payed out or taken in on the winch. A ferrule 16 is rigidly secured to the outer end of cable 14. A plurality of auxiliary, or choker, cables 18, 20, 22 are mounted on cable 14 through slidable connectors 24, 26, 28, respectively, which permit sliding of the choker cables along main cable 14, with ferrule 16 preventing the slide connectors from leaving the end of cable 14. The choker cables have hooks secured adjacent their outer sets of ends permitting them to be wrapped around logs such as those indicated at 32, 34 and tightened thereon for towing by cable 14 and the tractor.

When a choker cable, such as that indicated at 22 is not needed, it may be stored as illustrated on releasable line holding devices constructed according to the invention and illustrated at 38, 40 in the drawings. Devices 38, 40 are similar in construction, and thus only one will be described in detail.

Figure 2:
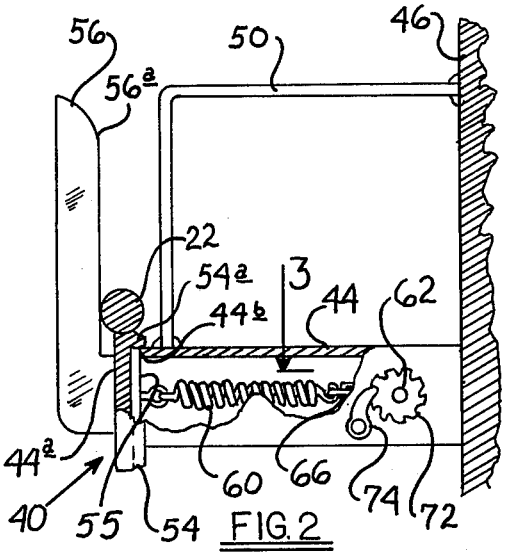
FIG. 2 is an enlarged side elevation view taken generally along the line 2—2 in FIG. 1 illustrating one of the line holding devices, with a portion broken away to illustrate the interior construction of the device.
Figure 4:
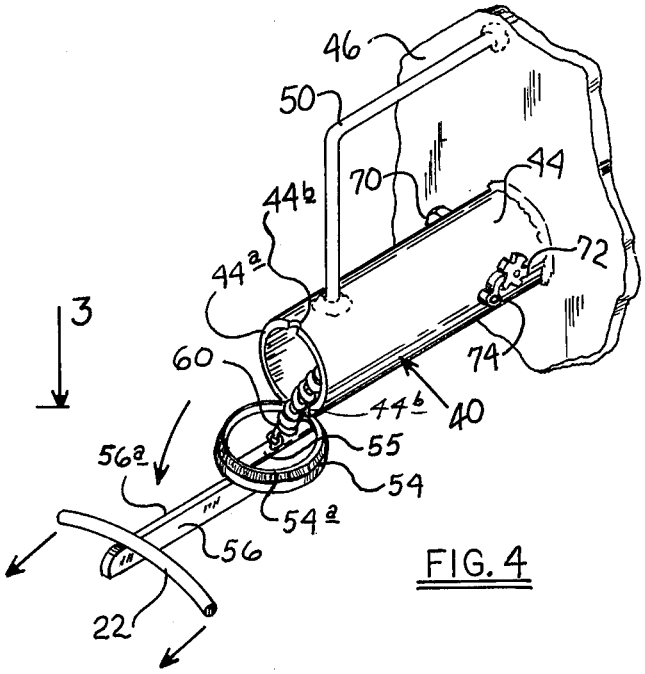
FIG. 4 is a perspective view of the device illustrating a release position therefor to release a portion of line therefrom.

Referring to line holding device 40 illustrated in FIGS. 2 and 4, it will be seen that the device includes an elongate, hollow, cylindrical tube, or mounting member 44 secured, as by welding, at one of its ends to an upright support wall 46 at the rear of tractor 10. As is seen, tube 44 projects substantially horizontally, or at a low angle relative to the horizontal, outwardly from support 46. The outer end of tube 44 presents an upright face surface **44*a* facing away from support 46. Notches 44*b* are formed at the top and bottom of end 44*a* of the tube (as seen in FIGS. 2 and 4**).

An L-shaped guide rod 50 is secured adjacent one of its ends to support 46 and at its other end to the top of tube 44 at a region spaced inwardly from face surface **44*a***.

A circular cap 54 having a circular lip 54*a* projecting outwardly therefrom is adapted to be received in face-to-face contact with face surface 44*a* of the tube as illustrated in FIG. 2. In this position, lip 54*a* is in position to engage side surfaces of tube 44 to inhibit shifting of the cap laterally of the tube. An elongate, half round member 55 is secured to the inner face of cap 54 and extends diametrically of the cap. Member 55 is adapted to fit in notches 44*b* to inhibit rotation of the cap when in place. This is also referred to as detent means herein.

An elongate substantially L-shaped arm 56 is secured, as by welding, to the outer surface of cap 54. Arm 56 has an inner line engaging surface 56*a*. When the cap 54 and arm 56 are in what is referred to herein as their holding position, as illustrated in FIG. 2, arm 56 is substantially upright with its line engaging surface 56*a* facing, but spaced a distance outwardly from, the upright leg of guide rod 50. In this position, a portion of a line 22 may be received between arm 56 and guide rod 50 as illustrated.

An elongate tension spring 60 is secured adjacent one of its ends to the center of cap 54, and extends inwardly through the channel formed by the hollow interior of tube 44 toward support 46.

Figure 3:
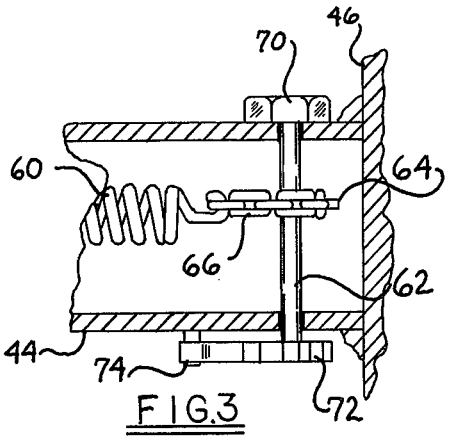
FIG. 3 is an enlarged cross-sectional view taken generally along the line 3—3 in FIG. 2.

Referring to FIG. 3, an elongate rod 62 extends transversely of and is rotatably mounted in tube 44 adjacent support 46. A pin 64 is secured to and projects radially outwardly from a midportion of rod 62. A multiple link chain 66 is connected at one of its ends to the end of spring 60 nearest support 46 and its other end is connected to pin 64.

A wrench-engageable head 70 outside tube 44 is secured to one end of rod 62 and a ratchet wheel 72 is secured to the opposite end of rod 62 and mounted exteriorly of tube 44. A pawl 74 is swingably mounted on tube 44 adjacent ratchet wheel 72 to engage the teeth on the ratchet wheel.

Rotation of rod 62 in one direction serves to take up chain 66 on the rod to stretch, and thus tighten or increase the tension in spring 60. Rotation of rod 62 in the opposite direction serves to pay out chain 66 from rod 62 to reduce the tension in spring 60. Pawl 74 when engaging the teeth of ratchet wheel 72 serves to hold the rod against paying out of the chain.

Describing now the operation of the apparatus, it is normally in the position illustrated in FIG. 2, with cap 54 received on the outwardly facing end of tube 44, member 55 received in notches 44*b*, and arm 56 in an upright holding position. Rod 62 may be rotated as desired to produce the desired tension in spring 60 yieldably biasing cap 54 against the outer end of tube 44 and then pawl 74 engaging the teeth of ratchet wheel 72 secures the rod against paying out of chain 66.

A portion of the line to be held is looped between the upright leg of guide rod 50 and upright surface 56*a* of arm 56. In this manner, the line may be held in a stored condition.

Should a force be applied to the line against surface 56*a* of the arm in substantially any direction, either longitudinally of spring 60 or at a substantial angle relative thereto, as by binding of slide connector 28 on line 14 when line 14 is forcibly paid out, which force is greater than the biasing force of spring 60, it will pull arm 56 toward a laid over release position as illustrated in FIG. 4 to permit release of cable 22 therefrom. The construction is such that a force applied to arm 56 by the cable at almost any angle directed away from support 46 which is of sufficient magnitude to overcome the urging of spring 60 will effect release of the cap and arm to release the cable. It should be recognized that member 55 received in notches 44*b* inhibits rotation of the cap and arm from its normally disposed upright operating position until sufficient line force is exerted thereagainst to force member 55 from the notches.

While a preferred embodiment of the invention has been described herein, it should be apparent to those skilled in the art that variations and modifications are possible without departing from the spirit of the invention.

It is claimed and desired to secure by Letters Patent:

1. Apparatus for releasably holding a line adjacent a support comprising a mounting member secured in a substantially stationary position relative to said support, an elongate arm spaced outwardly from said support shiftable between a substantially upright holding position and a laid over release position, adapted in its holding position to hold a line with a portion of the line on one side of said arm, means releasably connecting said arm to said mounting member including an elongate tension spring yieldably urging said arm in the direction of its said one said toward said holding position and permitting release of said arm from said holding position toward a release position greater than the urging force of said spring directed along a line extending either substantially longitudinally of said spring or at an angle relative to said spring and detent means operable to inhibit rotation of said arm from its upright position until sufficient release force is applied thereto to overcome said biasing force, and adjustment means for selectively varying the tension in said spring to change the biasing force urging said arm toward its holding position.

2. The apparatus of claim 1, wherein said adjustment means comprises an elongate flexible member connected to a portion of said spring spaced from said connecting means, means for taking up and paying out portions of said flexible member to change the length of said spring, and means for securing said flexible member in a selected position.

3. Apparatus for releasably holding a line adjacent a support comprising a mounting member secured in a substantially stationary position relative to said support and having a substantially upright face surface facing away from said support, an elongate arm spaced outwardly from said support shiftable between a substantially upright holding position and a laid over release position, adapted in its holding position to hold a line with a portion of the line on one side of said arm, and means releasably connecting said arm to said mounting member including a cap member to which said arm is secured and biasing means yieldably urging said arm in the direction of its said one side toward said holding position with said cap member yieldably biased into face-to-face contact with said face surface of said mounting member, said biasing means permitting release of said arm from said holding position toward a release position upon the application of a force to said one side of said arm greater than the urging force of said biasing means directed at substantially any angle against said one side of said arm.

4. The apparatus of claim 3, wherein said biasing means comprises a spring connected at one of its ends to said cap member and urging the same into contact with said mounting member.

5. The apparatus of claim 3, wherein said mounting member has a channel formed therein extending from said face surface toward said support and said biasing means comprises a spring connected adjacent one of its ends to said cap member and extending therefrom through said channel toward said support.

6. The apparatus of claim 3, wherein said cap member includes lip portions which extend outwardly from remainder portions thereof to engage side surfaces of said mounting member adjacent said face surface, with interengagement of said lip portions and side surfaces being operable to inhibit shifting of said cap member laterally of said mounting member when in face-to-face contact therewith.

7. Apparatus for releasably holding a line adjacent a support comprising a mounting member secured in a substantially stationary position relative to said support, said mounting member being secured to said support and extending outwardly therefrom at a low angle to the horizontal, having a face surface facing away from said support, and having a channel defined therein extending from said face surface toward said support, an elongate arm spaced outwardly from said support shiftable between a substantially upright holding position and a laid over release position, adapted in its holding position to hold a line with a portion of the line on one side of said arm, and means releasably connecting said arm to said mounting means including a cap member to which said arm is secured and biasing means including a spring connected adjacent one of its ends to said cap and extending inwardly along said channel toward said support yieldably urging said cap and arm in the direction of said one side of the arm toward said holding position, with said cap member being releasably biased into face-to-face contact with said face surface of said mounting member and having lip portions which extend outwardly from remainder portions thereof to engage side surfaces of said mounting member adjacent said face surface to inhibit shifting of said cap member laterally of said mounting member when in face-to-face contact therewith, said biasing means permitting release of said arm from said holding position toward a release position upon the application of a force to said one side of said arm greater than the urging force of said biasing means directed at substantially any angle against said one side of said arm.

8. Apparatus for releasably holding a line adjacent a support comprising a mounting member secured in a substantially stationary position relative to said support including an elongate tube having a cylindrical end spaced from said support, an elongate arm spaced outwardly from said support shiftable between a substantially upright holding position and a laid over release position, adapted in its holding position to hold a line with a portion of the line on one side of said arm, and means releasably connecting said arm to said mounting means including a cap having a circular lip thereon adapted to fit on said end of said tube with said lip positioned to engage side surfaces of said tube adjacent the end on which said cap is received, said lip inhibiting shifting of said cap laterally of said tube while permitting shifting of portions of the cap longitudinally outwardly from said tube, and biasing means yieldably urging said arm and cap in the direction of said one side of said arm toward said holding position and permitting release of said arm from said holding position toward a release position upon the application of a force to said one side of said arm greater than the urging force of said biasing means directed at substantially any angle against said one side of said arm.

9. Apparatus for releasably holding a line adjacent a support comprising a mounting member secured in a substantially stationary position relative to said support, said member comprising a tube having a circular mounting portion thereon spaced outwardly from said support and a channel formed therein progressing along said member away from said mounting portion, an elongate line holding arm, and connecting means releasably connecting said arm to said mounting member for shifting between a substantially upright holding position and a laid over release position, said arm in its holding position being adapted to hold a line with a portion of the line on the side of the arm facing said support, said connecting means including a cap having a circular lip thereon which extends outwardly from remainder portions thereof, said cap fitting on the end of said tube with said lip positioned to engage side surfaces of the tube to inhibit shifting of the cap laterally of the tube while permitting shifting of the cap or portions thereof longitudinally outwardly from said tube, and biasing means yieldably urging said cap and arm in the direction of said one side of the arm toward its holding position and permitting release of said arm from said holding position toward said release position upon the application of a force to said one side of the arm greater than the urging force of said biasing means directly at substantially any angle against said one side of said arm.

* * * * *